US008497621B2

(12) United States Patent
Kraus

(10) Patent No.: US 8,497,621 B2
(45) Date of Patent: Jul. 30, 2013

(54) ILLUMINATING DEVICE WITH LIGHT BUFFER

(75) Inventor: Robert Kraus, Regensburg (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 230 days.

(21) Appl. No.: 12/679,670

(22) PCT Filed: Sep. 24, 2008

(86) PCT No.: PCT/EP2008/008091

§ 371 (c)(1),
(2), (4) Date: Mar. 24, 2010

(87) PCT Pub. No.: WO2009/040111

PCT Pub. Date: Apr. 2, 2009

(65) Prior Publication Data

US 2010/0201284 A1 Aug. 12, 2010

(30) Foreign Application Priority Data

Sep. 24, 2007 (DE) ..... 10 2007 045 540

(51) Int. Cl.

| | |
|---|---|
| ***H01J 1/62*** | (2006.01) |
| ***H01J 63/04*** | (2006.01) |
| *H05B 41/16* | (2006.01) |
| *H05B 41/24* | (2006.01) |

(52) U.S. Cl.
USPC ..... 313/486; 315/246

(58) Field of Classification Search
None
See application file for complete search history.

(56) References Cited

U.S. PATENT DOCUMENTS

| | | | | |
|---|---|---|---|---|
| 4,066,711 | A | 1/1978 | Melaja et al. | |
| 6,227,679 | B1 * | 5/2001 | Zhang et al. | 362/236 |
| 7,114,830 | B2 * | 10/2006 | Robertson et al. | 362/240 |
| 7,488,432 | B2 * | 2/2009 | Murazaki et al. | 252/301.4 R |
| 2006/0228973 | A1 * | 10/2006 | Janning | 445/24 |
| 2007/0103899 | A1 | 5/2007 | Takikawa | |
| 2007/0147032 | A1 * | 6/2007 | Furukawa et al. | 362/230 |
| 2007/0215890 | A1 | 9/2007 | Harbers et al. | |
| 2007/0278502 | A1 | 12/2007 | Shakuda et al. | |

FOREIGN PATENT DOCUMENTS

| | | | |
|---|---|---|---|
| AT | 170777 | B | 3/1952 |
| CN | 1242871 | A | 1/2000 |
| GB | 2366610 | A | 3/2002 |
| WO | 99021214 | A1 | 4/1999 |

OTHER PUBLICATIONS

English translation of the International Preliminary Report on Patantability of PCT/EP2008/008091 issued on May 4, 2010.
English abstract for KR 1020070070147A.
International Search Report of PCT/EP2008/008091.
German Search Report dated Feb. 18, 2010.
English translation of German Search Report dated Feb. 18, 2010.

* cited by examiner

*Primary Examiner* — Douglas W Owens
*Assistant Examiner* — Dedei K Hammond

(57) ABSTRACT

A light-emitting device may include at least one light source, which is configured for at least one of AC and PWM operation; and at least two optical buffers for absorbing light energy from the light source and for temporally delayed emission of the stored luminous energy, wherein the at least two optical buffers have different relaxation times and are sensitive to different wavelengths.

20 Claims, 2 Drawing Sheets

ILLUMINATING DEVICE WITH LIGHT BUFFER

RELATED APPLICATIONS

The present application is a national stage entry according to 35 U.S.C. §371 of PCT application No. PCT/EP2008/008091 filed on Sep. 24, 2008, which claims priority from German application No. 10 2007 045 540.4 filed on Sep. 24, 2007.

TECHNICAL FIELD

Various embodiments relate to an illuminating device with light buffer.

BACKGROUND

Disruptive flicker is often observed in the case of light sources which are driven by AC voltage or alternating current or are controlled by PWM. This problem is particularly pronounced for light-emitting diodes (LEDs), since the illumination of LEDs as current-controlled component parts is substantially dependent on the impressed current and ceases virtually immediately when the current falls below a specific value (level).

In the case of lamps which are operated using AC sources, rectifiers with smoothing capacitors are generally required in order to suppress flicker, i.e. additional electronics, which is associated with additional manufacturing complexity. In addition, the probability of failure of the circuit is increased thereby. In order to effectively avoid a fluctuation in the current/voltage, relatively large capacitors generally need to be used, which take up a large amount of space.

SUMMARY

Various embodiments provide a light-emitting device which suppresses flicker effectively as a result of a light source operated on alternating current and/or by means of pulse width modulation (PWM) and in addition is simple in terms of manufacture, reliable and robust.

This object is achieved by means of a light-emitting device comprising: at least one light source, which is configured for at least one of AC and PWM operation; and at least two optical buffers for absorbing light energy from the light source and for temporally delayed emission of the stored luminous energy, wherein the at least two optical buffers have different relaxation times and are sensitive to different wavelengths and a method comprising: operating a light source at least one of on alternating current and in the PWM operating mode; absorbing luminous energy emitted by the light source by at least one optical buffer; emitting the absorbed luminous energy again with a time delay; wherein the at least two optical buffers have different relaxation times and are sensitive to different. Advantageous configurations are given in particular in any dependent claims.

The light-emitting device has at least one light source, in particular a light-emitting diode, which is suitable for operation on alternating current and/or with pulse width modulation. In addition, the light-emitting device has an optical buffer for absorbing light energy from the light source and for time-delayed emission of the stored luminous energy. In other words, the optical buffer serves the purpose of absorbing the luminous energy from the light source during illumination of the light source, in the "on" phase (pumping) in order to continue to illuminate in the so-called "off" phase of the light source (relaxation) and therefore to reduce the flicker of the light-emitting device during operation. The associated relaxation time t relax is defined as the time in which the radiation intensity drops by the factor e when the primary radiation is switched off. An optical buffer can also have a plurality of different relaxation times, for example depending on the irradiated wavelength.

Preferred is a light source or lamp which is operated on alternating current.

For more effective smoothing of the light emission amplitude over time ("smearing"), the light-emitting device has at least two optical buffers with different relaxation times.

It may be advantageous if at least two optical buffers with different relaxation times are sensitive to different wavelengths.

In general, it may be advantageous if those optical buffers which are sensitive to a relatively short wavelength have a relatively long relaxation time.

In particular it is advantageous if that optical buffer which is sensitive to the shortest wavelength has the longest relaxation time.

In general, the optical buffer can be arranged both in the direct vicinity of the light source (for example on the LED chip, in or on the LED package etc.) and remote from the light source. Preferred is a light-emitting device in which that optical buffer of the at least one light source which is sensitive to the shortest wavelength is arranged next.

Furthermore preferred is a light-emitting device in which at least one optical buffer additionally has a wavelength-converting property. As a result, a color emission of the lamp can be adjusted in addition in a simple and space-saving manner.

In general, a light source, in particular an LED can be used for this purpose which produces a primary radiation with a wavelength which is shorter than the secondary radiation emitted by the conversion layers. UV-LEDs are particularly advantageous in this regard since the primary radiation is invisible. "Color flicker" caused by the primary radiation is therefore not visible. In addition, UV-LEDs have a high luminous efficiency.

Preferred is in particular a light-emitting device in which the optical buffer which is sensitive to the shortest wavelength does not have any or does not have any significant quantity of wavelength conversion material.

For particularly simple and reliable manufacture and handling, the wavelength conversion material comprises phosphor.

One or more suitable phosphorescent or luminescent materials, in particular those based on phosphor, can be used as optical buffer materials and/or conversion materials. Examples of materials which are suitable as optical buffer materials and/or conversion materials are as follows:

white phosphor;

yellow phosphor (for example Ce-activated yttrium-aluminum-garnet Y3 (Al, Si)5012:Ce(YAG:Ce));

red phosphor (for example activated by Eu or Sn).

The white phosphor used can be, inter alia, gallophosphates such as silicates (for example based on zinc-gallophosphate with nanopores, Eu-doped silicates, such as $Li_2SrSiO_4$:Eu(2+), $Ba_9Sc_2Si_6O_{24}$:Eu(2+), $Ca_3Si_2O_7$:Eu(2+), Sr orthosilicates $Sr_2SiO_4$[Eu(2+), La(3+)]).

In general, the optical buffer material or materials of the respective optical buffer and the wavelength conversion material or materials can correspond to one another (i.e. have both an optical buffer property and a wavelength conversion property) or can be selected substantially only for in each case one of the properties.

For even more effective smearing, the relaxation time t_relax of at least one optical buffer, in particular of that optical buffer which is arranged next with respect to the light source (s) in the case of a plurality of optical buffers, is greater than the period T of the AC voltage, i.e. t_relax>T. If the optical buffer has chemical components or subregions with a plurality of relaxation times (for example in the case of different wavelengths of the emitted radiation), it is preferred if this condition is met at least for a relaxation time.

Preferred is a light-emitting device in which a half-value decay time of the optical buffer is at least 1 ms, preferably at least 5 ms, further preferably at least 10 ms. Half-value decay times of markedly below 1 ms are less preferred since, at very high current frequencies (for example during PWM operation at a high frequency), the eye integrates differences in light and, over long periods of time in the dark (for example very low AC frequencies), a half-value decay time can then not effectively suppress the flicker. Half-value decay time is understood to mean that period of time, which may be frequency dependent, of a material with afterglow at which a luminous intensity once the primary light source has switched off is now only 50% of the initial luminous intensity at the switch-off time.

Particularly preferred is a relaxation time of at least one optical buffer which is greater than approximately five times the period T of the AC voltage, i.e. t_relax>5·T.

Further preferred is if the relaxation time is greater than ten times the period T of the AC voltage, but less than fifty times the period T of the AC voltage, i.e. 10·T<t_relax<50·T. Thus, in the case of such an optical buffer for a light emitting device operated by a 50 Hz system voltage, a preferred relaxation time t_relax of approximately 0.2 s to approximately 1 s results.

For example, the known phosphors have relaxation times of less than 1 μs up to hours, with the result that these times can easily be realized by the selection of the suitable phosphor (for example white phosphor).

Furthermore preferred is a light-emitting device which has, as light source, a chain including a plurality of LEDs, which are connected back-to-back in parallel and can be connected directly to the power source.

Also preferred is a light-emitting device which has a driver for driving the at least one light source, which driver includes a rectifier without a smoothing capacitor or with a smooth capacitor which has only small dimensions.

Preference can also be given to a light-emitting device which has an incandescent lamp base.

However, preference can also be given to a light-emitting device which is designed to be inserted into a fluorescent lamp lampholder.

These so-called retrofit lamps particularly preferably fit substantially into a standardized contour, for example E26.

Various embodiments provide a luminaire which has at least one such lamp as described above.

Various embodiments provide a method for illuminating, in which a light source, e.g. a light-emitting diode, is operated on alternating current and/or in the PWM operating mode, luminous energy emitted by the light source is absorbed by at least one optical buffer and the absorbed luminous energy is emitted again with a time delay for smoothing of a luminous intensity.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
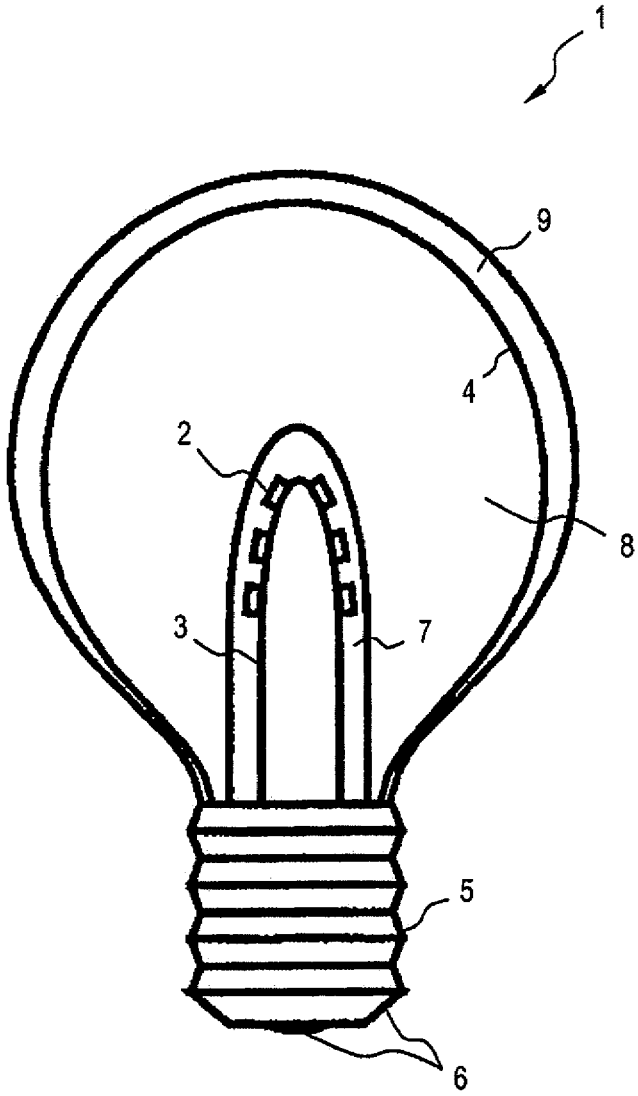
FIG. 1 shows a cross-sectional illustration in a side view of a retrofit lamp according to the invention, for an incandescent bulb based on an LED.

FIG. 1 shows a light-emitting device 1 in the form of a so-called retrofit lamp for an incandescent bulb with an E26 contour on the basis of ultraviolet-emitting light-emitting diodes (UV-LEDs) 2 as light source(s). The UV-LEDs 2 are fitted symmetrically in the circumferential direction on a substrate 3, which in this case is in the form of a metal-core printed circuit board. The substrate 3 and a transparent bulb or envelope 4 surrounding the substrate 3 and the LEDs are held on an Edison base 5, which has known electrical contacts 6 for supplying power to the LEDs 2.

The UV-LEDs 2 are wired in such a way that they are arranged in branches of an LED chain, the branches being connected back-to-back in parallel with one another and the chain being connected directly to the contacts 6 of the base 5. Each LED 2 therefore draws current from a half-cycle of the applied alternating current of in this case 50 Hz, by way of example, and correspondingly illuminates 50 times per second if the current or the voltage of the half-cycle exceeds a certain threshold value.

In the case of this lamp 1, three optical buffers are provided or the optical buffer is split into three zones. A layered near-zone optical buffer 7 is arranged in the direct vicinity of the light sources 2. A diffusely scattering intermediate-zone optical buffer 8 surrounds the near-zone optical buffer 7. In turn, the intermediate-zone optical buffer 8 is surrounded by a far-zone optical buffer 9, which is applied in layered fashion on the bulb 4.

The intermediate-zone optical buffer 8 and the far-zone optical buffer 9 have phosphorescent additives, which serve the purpose of generating the desired color spectrum of the light-emitting device 1.

The near-zone optical buffer 7 has a relaxation time t_relax_n, the intermediate-zone optical buffer 8 has a relaxation time t_relax_i, and the far-zone optical buffer 9 has a relaxation time t_relax_f, which relaxation times are different than one another. In this case, relaxation times are selected such that the condition t_relax_n>max (t_relax_i, t_relax_f) is met.

During operation on the 50 Hz system voltage selected by way of example here, the LEDs illuminate with corresponding frequency. Then, the luminous energy emitted by the LEDs is first absorbed to a significant extent by the near-zone optical buffer 7 and is emitted again with a time delay with a corresponding relaxation time t_relax_n at the same wavelength. As a result of the near-zone optical buffer 7, the luminous flux peaks of the LEDs thus "smear", as a result of which flicker of the light-emitting device 1 is reduced. The UV light emitted again by the near-zone optical buffer 7 then passes to the intermediate-zone optical buffer 8, where it is likewise absorbed and emitted again. However, the emission now takes place with a longer relaxation time t_relax_i. In addition, the intermediate-zone optical buffer 8 has a wavelength conversion material, with the result that the light emitted thereby is shifted into the visible range. Similarly, light emitted by the intermediate-zone optical buffer 8 passes to the far-zone optical buffer 9. There, the light is absorbed and emitted again with a relaxation time t_relax_i, which is likewise greater than t_relax_n. The far-zone optical buffer 8 also has at least one wavelength conversion material, with the result that the light emitted thereby has a wavelength which is shifted into a specific visible region, which at least partially differs from that spectral region which is emitted by the intermediate-zone optical buffer 8. By suitable selection of the thicknesses of the optical buffers 7, 8, 9, of their optical buffer materials and material thicknesses, and of their wavelength conversion material, their wavelength conversion material density uvm, an LED light-emitting device 1 can be achieved which does not flicker or only flickers to a very small extent and in addition has a defined color emission.

Figure 2:
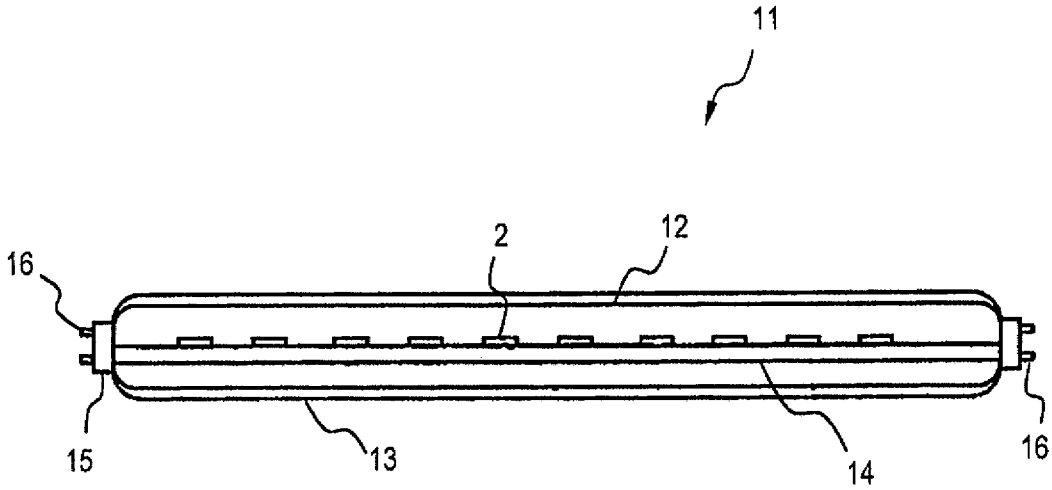
FIG. 2 shows a cross-sectional illustration as a side view of a retrofit lamp according to the invention for a fluorescent tube based on LEDs.

FIG. 2 shows a light-emitting device 11 in the form of a retrofit LED lamp for a fluorescent tube. The optical buffer 12 in the form of a phosphorescent layer is applied to a glass envelope 13. UV-LEDs 2, which are arranged on a substrate 14, are likewise used as light source. The base 15 and the contact 16 are designed in such a way that the lamp 11 can be inserted into a conventional lampholder of a fluorescent lamp. In this case, therefore, only 1 optical buffer 12 is provided, which absorbs the UV light emitted by the LEDs 2 and emits wavelength-converted light in the visible range with a relaxation time t_relax again.

The present invention is of course not restricted to the embodiments disclosed. For example, other light sources instead of an LED can also be used, for example a compact fluorescent tube. White or monochromatic or clusters of monochromatic light sources can also be used. The lamps do not have to be in the form of retrofit lamps. It is also not necessary for there to be any wavelength conversion. The power source can also have a different frequency than 50 Hz, for example 60 Hz, and can in addition or alternatively be pulse width modulated. Then, the relaxation time of at least one optical buffer is preferably matched to a typical distance between the "on" phases of the PWM.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Light-emitting device
2 LED
3 Substrate
4 Bulb
5 Base
6 Electrical contact
7 Near-zone optical buffer
8 Intermediate-zone optical buffer
9 Far-zone optical buffer
11 Fluorescent tube
12 Optical buffer
13 Glass envelope
14 Substrate
15 Base
16 Contact
t_relax Relaxation time of optical buffer 12
t_relax_n Relaxation time of near-zone optical buffer 7
t_relax_i Relaxation time of intermediate-zone optical buffer 8
t_relax_f Relaxation time of far-zone optical buffer 9

What is claimed is:

1. A lamp, comprising:

at least one light emitting diode, which is configured for at least one of AC and PWM operation; and at least two optical buffers for absorbing light energy from the light emitting diode and for temporally delayed emission of the stored luminous energy;

wherein the at least two optical buffers are arranged outside the at least one light emitting diode and wherein the at least two optical buffers have different relaxation times and are sensitive to different wavelengths.

2. The lamp as claimed in claim 1, the at least two optical buffers comprising a layered near-zone optical buffer in the direct vicinity of the at least one light emitting diode and a far-zone optical buffer, which is spaced apart from the at least one light emitting diode.

3. The lamp as claimed in claim 2, further comprising: a diffusely scattering intermediate-zone optical buffer, which surrounds the near-zone optical buffer and is surrounded by the far-zone optical buffer.

4. The lamp as claimed in claim 1, wherein the optical buffer which is sensitive to the shortest wavelength has the longest relaxation time.

5. The lamp as claimed in claim 1, wherein that optical buffer of the at least one light emitting diode which is sensitive to the shortest wavelength is arranged next to the at least one light emitting diode.

6. The lamp as claimed in claim 1, wherein at least one of the optical buffers has, in addition, a wavelength-converting property.

7. The lamp as claimed in claim 1, wherein a half-value decay time of at least one of the optical buffer is at least 1 ms.

8. The lamp as claimed in claim 1, wherein the light emitting diode is configured to be operated on AC voltage.

9. The lamp as claimed in claim 8, wherein a relaxation time of at least one optical buffer is greater than the period of the AC voltage.

10. The lamp as claimed in claim 9, wherein the relaxation time of the at least one optical buffer is greater than five times the period of the AC voltage.

11. The lamp as claimed in claim 10, wherein the relaxation time is ten times longer than the period of the AC voltage, but shorter than fifty times the period of the AC voltage.

12. The lamp as claimed in claim 1, which has a chain comprising a plurality of LEDs, which are connected back-to-back in parallel and can be connected directly to the power source.

13. The lamp as claimed in claim 1, which has a driver for driving the at least one light emitting diode, said driver comprising a rectifier without a smoothing capacitor.

14. The lamp as claimed in claim 2, which has an incandescent lamp base, wherein the far-zone optical buffer is applied in layered fashion to a bulb of the lamp.

15. The lamp as claimed in claim 1, which is configured to be inserted into a fluorescent lamp lampholder.

16. A method for illumination, comprising:

operating a light emitting diode at least one of on alternating current and in the PWM operating mode;

absorbing luminous energy emitted by the light emitting diode by at least two optical buffers arranged outside the light emitting diode;

emitting the absorbed luminous energy again with a time delay;

wherein the at least two optical buffers have different relaxation times and are sensitive to different wavelengths.

17. A lamp as claimed in claim 2, wherein the near-zone optical buffer covers several light emitting diodes.

18. A lamp as claimed in claim 1, wherein at least one of the at least two optical buffers buffer does not have a wavelength conversion material.

19. The lamp as claimed in claim 18, wherein the optical buffer which is sensitive to the shortest wavelength has the longest relaxation time; wherein at least one of the optical buffers has, in addition, a wavelength-converting property; wherein the optical buffer which is sensitive to the shortest wavelength does not have a wavelength conversion material.

20. A lamp as claimed in claim 1, wherein the lamp is a retrofit lamp.

* * * * *